US006644877B1

(12) United States Patent
Chen

(10) Patent No.: US 6,644,877 B1
(45) Date of Patent: Nov. 11, 2003

(54) DETERGENT FEEDING MECHANISM FOR A CLEANING DEVICE

(76) Inventor: He-Jin Chen, No. 11, Lane 188, Gunngye Rd., Lung Shiang, Taichung (TW)

( * ) Notice: Subject to any disclaimer, the term of this patent is extended or adjusted under 35 U.S.C. 154(b) by 0 days.

(21) Appl. No.: 10/404,127

(22) Filed: Apr. 2, 2003

(51) Int. Cl.[7] ..... A46B 11/00; A46B 11/04

(52) U.S. Cl. ..... 401/140; 401/270; 401/277; 401/279

(58) Field of Search ..... 401/140, 137, 401/138, 139, 270, 277, 278, 279, 280

(56) References Cited

U.S. PATENT DOCUMENTS 2,633,590 A * 4/1953 Mitchell ..... 401/279

3,176,339 A * 4/1965 McDonald et al. ..... 401/22

* cited by examiner

*Primary Examiner*—David J. Walczak
(74) *Attorney, Agent, or Firm*—Bacon & Thomas, PLLC

(57) ABSTRACT

A cleaning tool includes a hollow rod extending through a tank for receiving detergent and connected to a cleaning member at a lower open end of the rod. A detergent feeding mechanism is received in the rod and includes a valve body which has a lower open end sealed by a guide member extending therethrough. The rod has an aperture located in the tank so that the detergent flows into the rod. The guide member is connected to a head which is fixed to a movable member received in the rod. A collar is rotatably connected to the movable member so that when rotating the collar, the movable member together with the head is moved longitudinally in the rod to open the lower open end of the valve body so that detergent is supplied to the cleaning member. The collar is located close to the handle of the rod and is convenient to be accessed by the users.

6 Claims, 12 Drawing Sheets

DETERGENT FEEDING MECHANISM FOR A CLEANING DEVICE

FIELD OF THE INVENTION

The present invention relates to mop that has a detergent tank connected to the rod of the mop and a detergent feeding mechanism is controlled by rotating a collar located close to the handle of the rod.

BACKGROUND OF THE INVENTION

A conventional mop 10 is shown in FIG. 1 and includes a rod 11 which is extends through a frame 12 and fixed to a sponge 14. Two squeeze rollers 121 are mounted to pins extending from two sides of the frame 12 and located on a top of the sponge 14. A pull device 13 includes two links 132 pivotally connected to two plates 133 connected to the rod 11 and a pull handle 131. The two links 132 extend through the frame 12 and fixed to the sponge 14 so that when pulling the pull handle 131 upward, the two links 132 lift the sponge 14 which is then squeezed by the rollers 121 so as to remove liquid in the sponge 14. The uses have to add detergent before using the mop 10 to clean the floor or the like. In other words, the users have to prepare two items, the mop 10 and the detergent to complete a cleaning work.

FIGS. 2 and 3 show a mop 20 that has a tank 25 for receiving detergent therein. A valve 26 is connected between the tank 25 and a passage 224 defined in the frame 22 so as to provide detergent to the sponge 24 via a hole 241 in the sponge 24. The frame 22 includes an opening 223 for engagement with the valve 26. The sponge 24 is connected to a pull device 23 which includes two links 233 fixed to the sponge 24, a pull handle 232 which is pivotably connected to the rod 21 by two plates 231. The sponge 24 can be squeezed by pulling the pull handle 232 to allow the rollers 221 to squeeze the sponge 24. The users have to bow down to operate the valve 26 whenever to open the valve 26 or close the valve 26. The tank 25 is attached to a side of the rod 21 so that the appearance of the whole assembly is bulky and dumb. Besides, the tank 25 projects out from a side of the rod 21 is easily by hit or damaged by foreign objects.

The present invention intends to provide a mop that has a tank through which the rod extends, and a detergent feeding mechanism is used to control a valve to allow the detergent to flow to the sponge, wherein a collar that controls the valve is located close to the handle of the rod so that the user can easily operate the collar.

SUMMARY OF THE INVENTION

In accordance with one aspect of the present invention, there is provided a cleaning tool which comprises a hollow rod having an aperture defined through the wall of the rod and located close to a lower open end of the rod. The rod is connected to a cleaning member by a universal member and a passage is defined through the universal member and communicates with lower open end of the rod.

A tank has a first fitting on a top of the tank and a second fitting on a bottom of the tank. The lower open end of the rod extends through the tank via the first fitting and the second fitting. The aperture in the rod is located in the tank.

A detergent feeding mechanism includes a collar which is rotatably mounted to the rod and located close to a handle portion of the rod. A movable member is engaged with the collar and movable along the rod by rotating the collar. A guide member is received in the rod and has a head which is fixed to the movable member. A valve body is secured in the rod and the guide member movably extends through the valve body. A chamber is defined in the valve body and an end member on the guide member is movably received in the chamber. A side hole is defined through a wall of the valve body and communicates with the chamber of the valve body and the aperture in the rod. An end member is connected to the guide member and disengageably seals a lower open end of the valve body.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
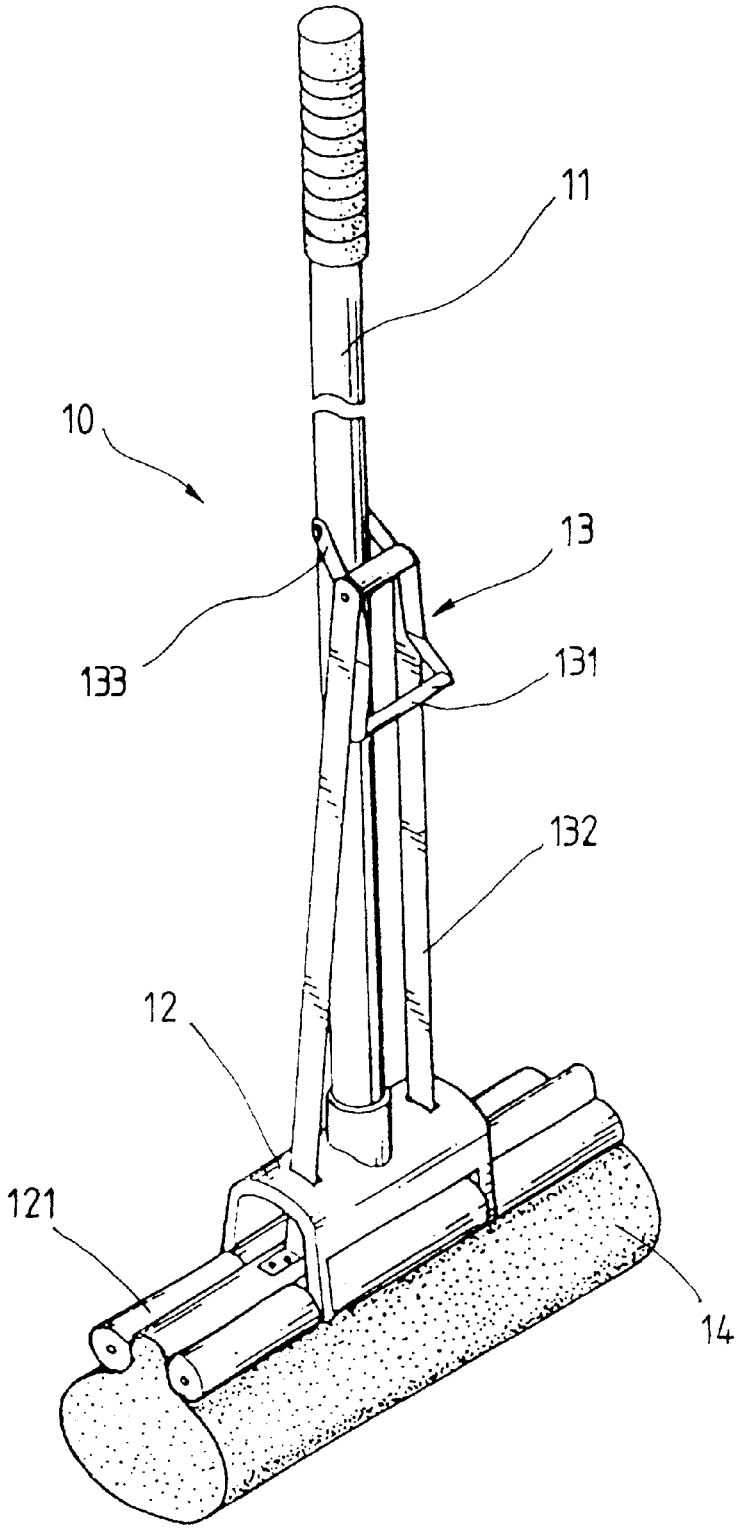
FIG. 1 PRIOR ART
FIG. 1 is a perspective view to show the conventional mop.
Figure 2:
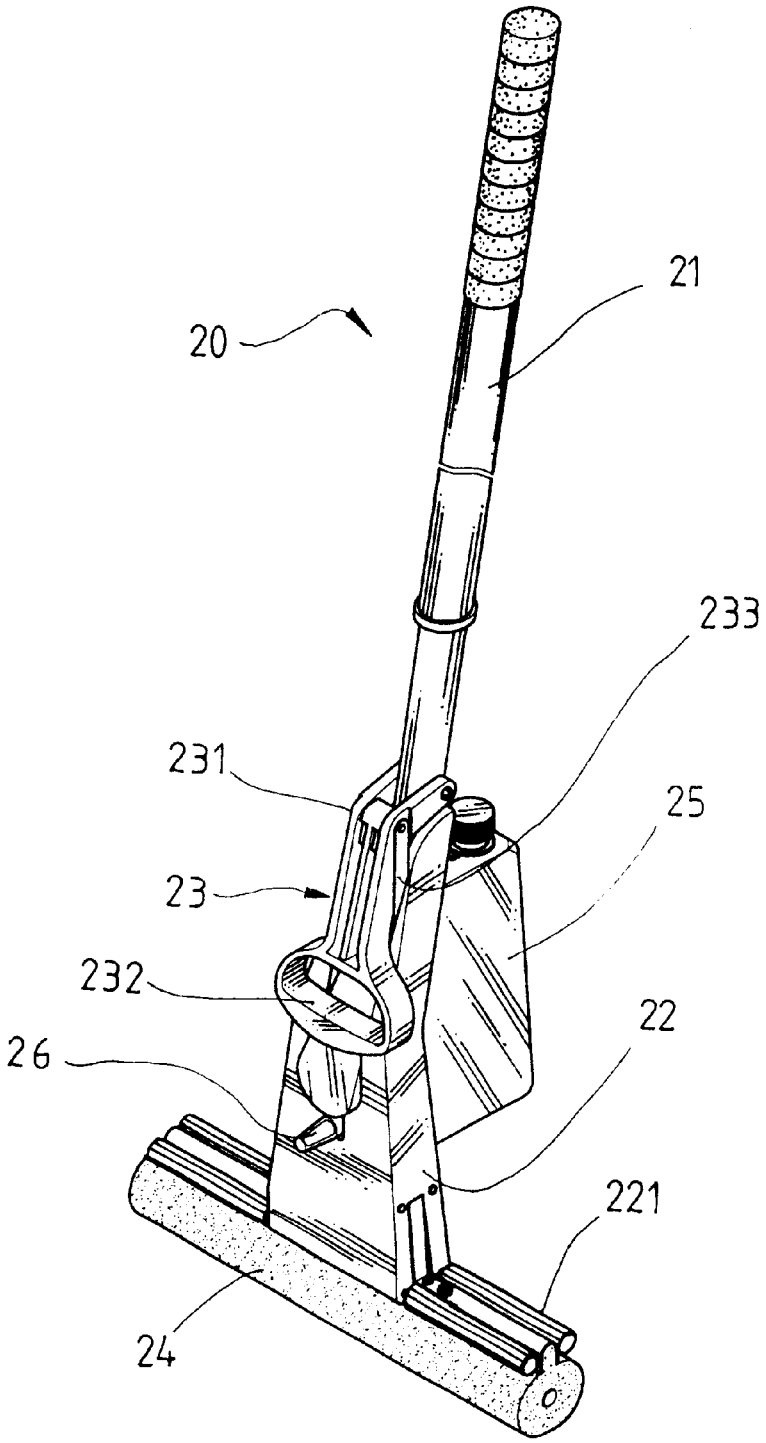
FIG. 2 PRIOR ART
FIG. 2 is a perspective view to show another conventional mop which has a detergent tank attached thereto.
Figure 3:
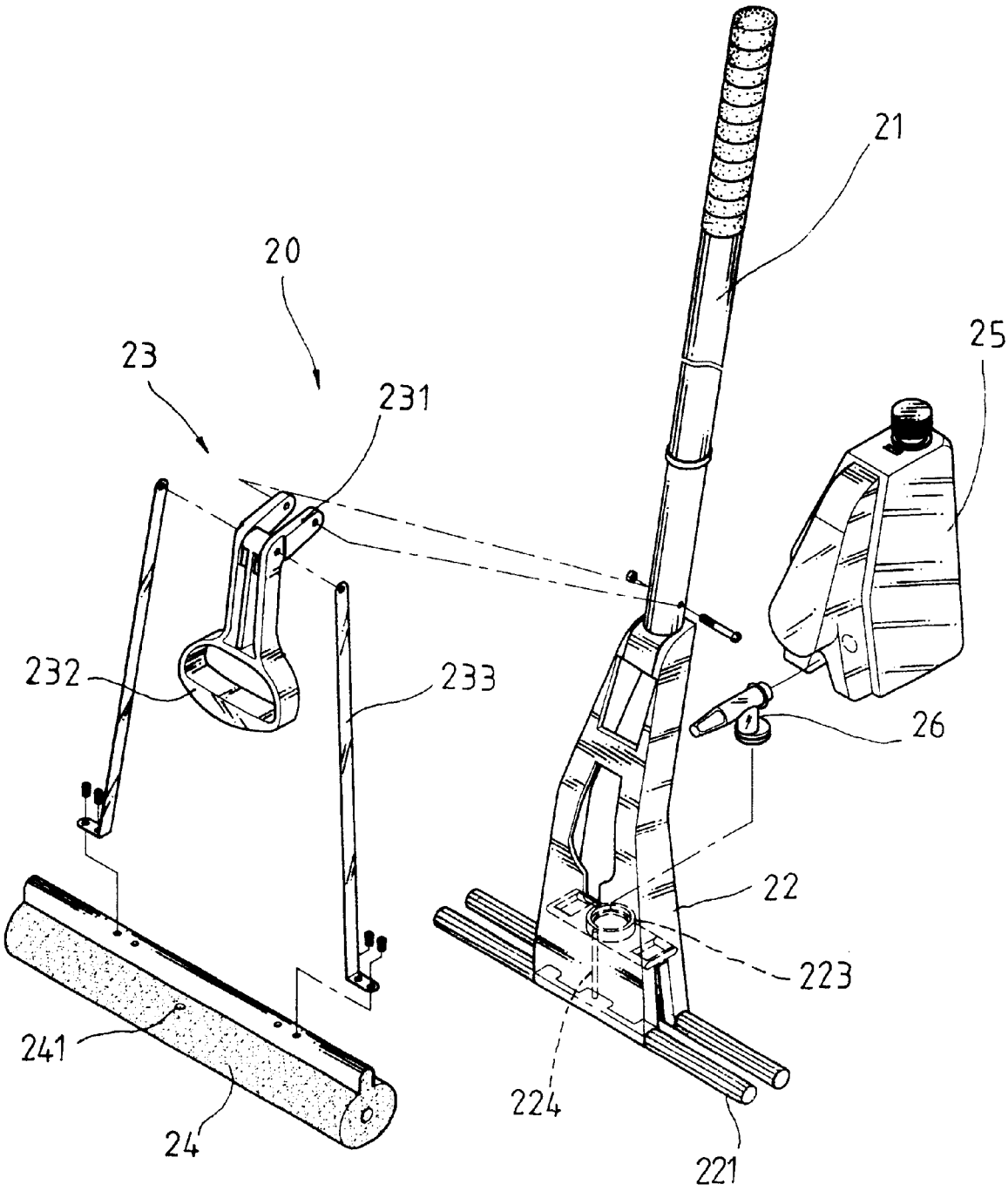
FIG. 3 PRIOR ART
FIG. 3 is an exploded view to show the conventional mop as shown in FIG. 2.
Figure 4:
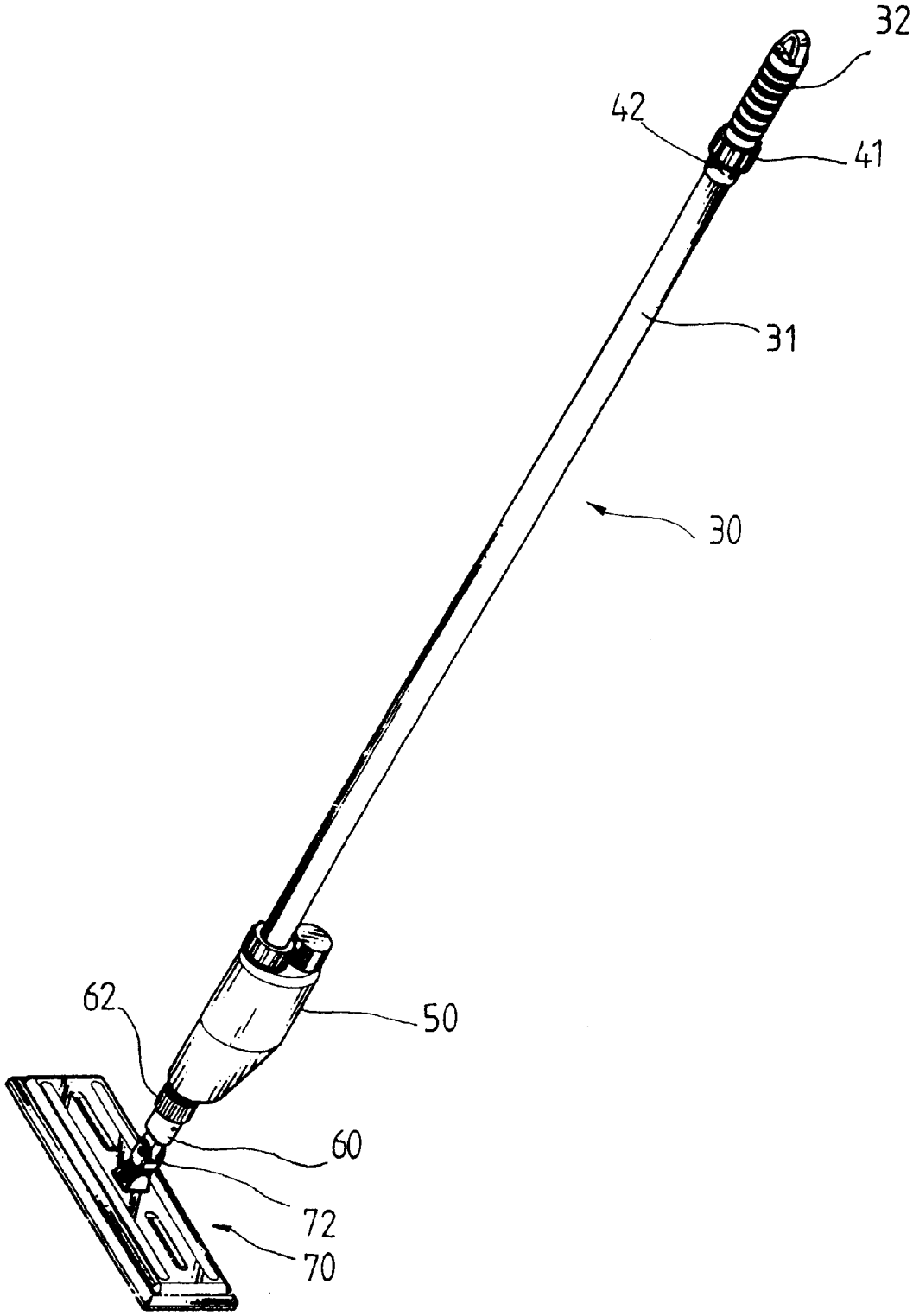
FIG. 4 is a perspective view to show the cleaning tool of the present invention.
Figure 5:
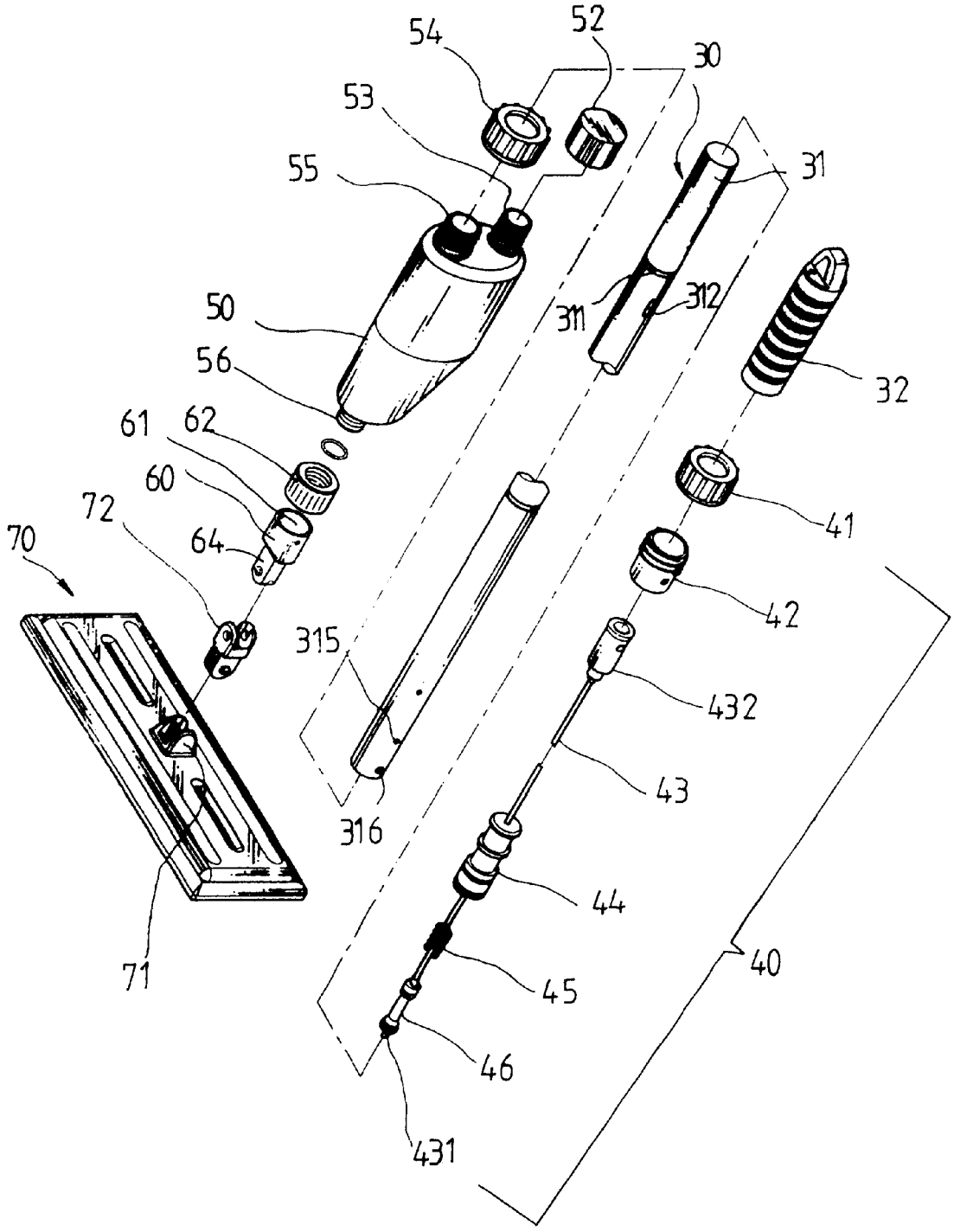
FIG. 5 is an exploded view to show the detergent feeding mechanism of the cleaning tool of the present invention.
Figure 6:
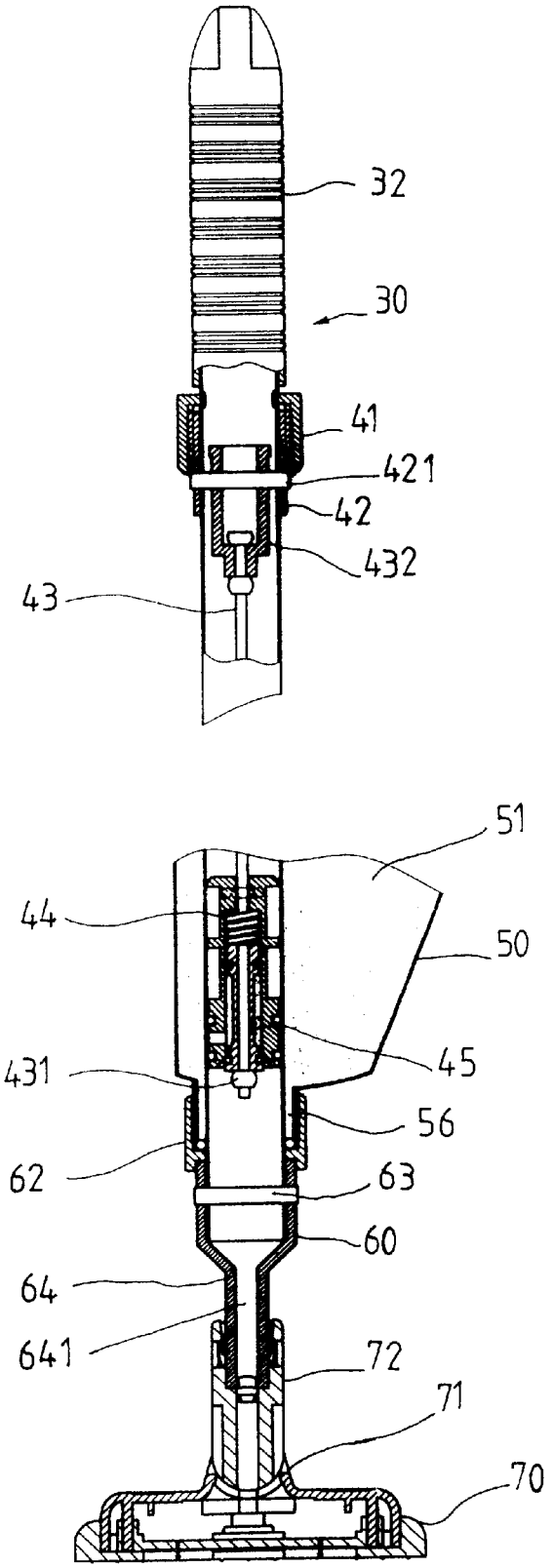
FIG. 6 shows a cross sectional view of the cleaning tool of the present invention.

Referring to FIGS. 4 to 6, the cleaning tool of the present invention comprises a hollow rod 30 which can be composed of several sections and has a slot 312 defined through a wall thereof and located close to a handle portion 31 of the rod 30. A grasp cap 32 is mounted to the handle portion 31 for convenience of grasp for the users. An aperture 315 is defined through the wall of the rod 30 and located close to a lower open end of the rod 30.

A connection piece 60 is securely mounted to the lower open end of the rod 30 by extending a pin 63 through a hole 316 in the rod 30 and the connection piece 60. The connection piece 60 has a neck portion 64 and a passage 641 is defined in the neck portion 64 and communicates with the lower open end of the rod 30.

Figure 8A:
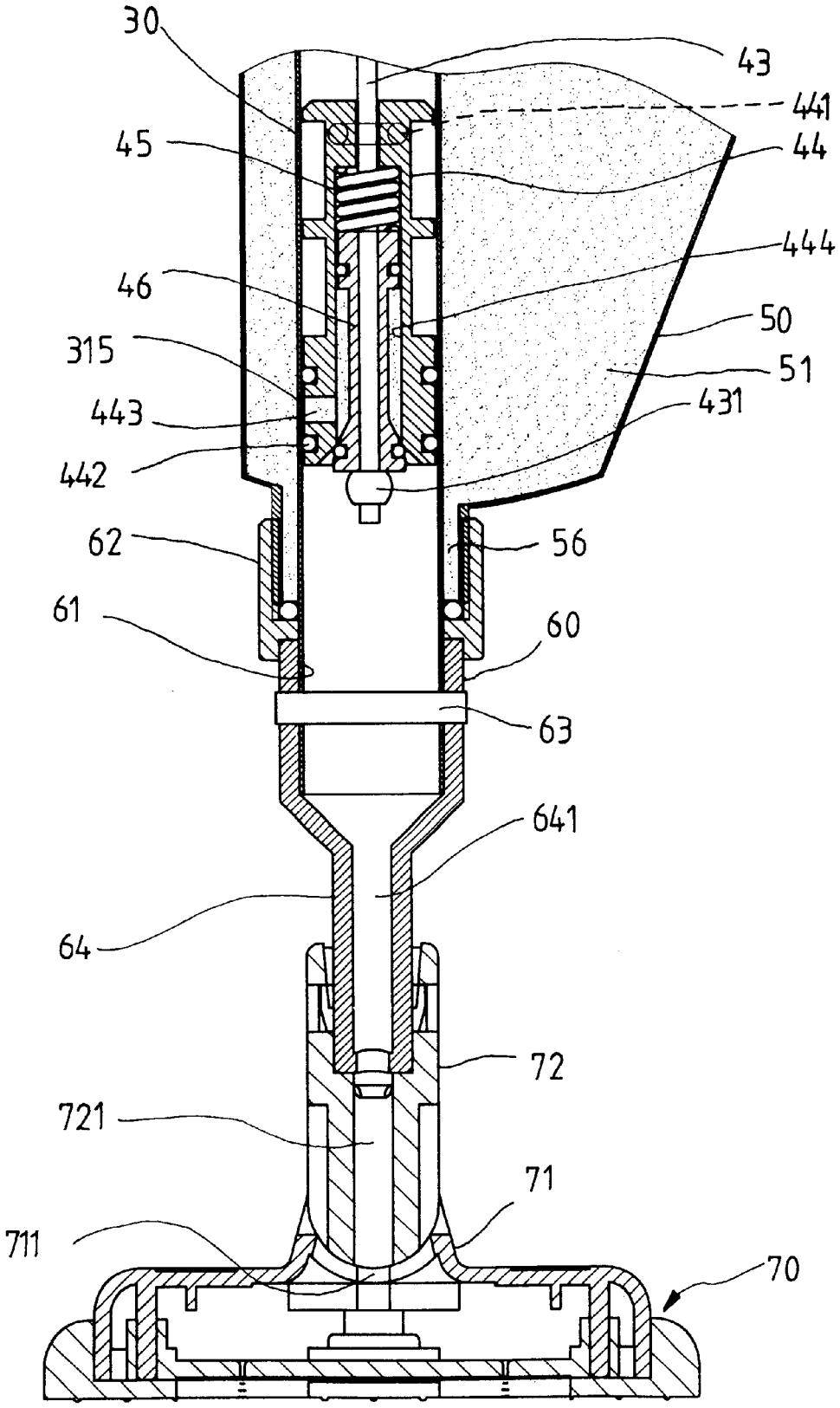
FIG. 8A is a cross sectional view to show the lower section of the detergent feeding mechanism and the cleaning member.

Further referring FIG. 8A, a universal member 72 is connected to a lower end of the neck portion 64 of the connection piece 60 and pivotally connected to a cleaning member 70. A passage 721 is defined through the universal member 72 and communicates with the passage 641 in the connection piece 60 and a hole 711 defined in a top of the cleaning member 70. The cleaning member 70 includes two lugs 71 between which the universal member 72 is engaged.

A tank 50 for receiving detergent has a first fitting 55 on a top of the tank 50 and a second fitting 56 on a bottom of the tank 50. The lower open end of the rod 30 extends through the tank 50 via the first fitting 55 and the second fitting 56. A first fixing collar 54 and a second fixing collar 62 are respectively threadedly mounted to the first fitting 55 and the second fitting 56 to fix the tank 50 to the rod 30. The aperture 315 in the rod 30 is located in the tank 50. An inlet 53 is defined in the top of the tank 50 and sealed by a cap 52 so that detergent can be supplied into the tank 50 via the inlet 53.

A detergent feeding mechanism 40 includes a collar 41 which is rotatably mounted to the rod 30 and is engaged with a groove 311 defined in an outer periphery of the rod 30, so that the collar 41 can only be rotated and cannot be moved relative to the rod 30. The collar 41 is located close to the handle portion 31. A movable member 42 is threadedly engaged with the collar 41 and a pin 421 extends through the movable member 42 and the slot 312 so that the movable member 42 is longitudinally movable in a range of the slot 312 by rotating the collar 41.

Figure 7A:
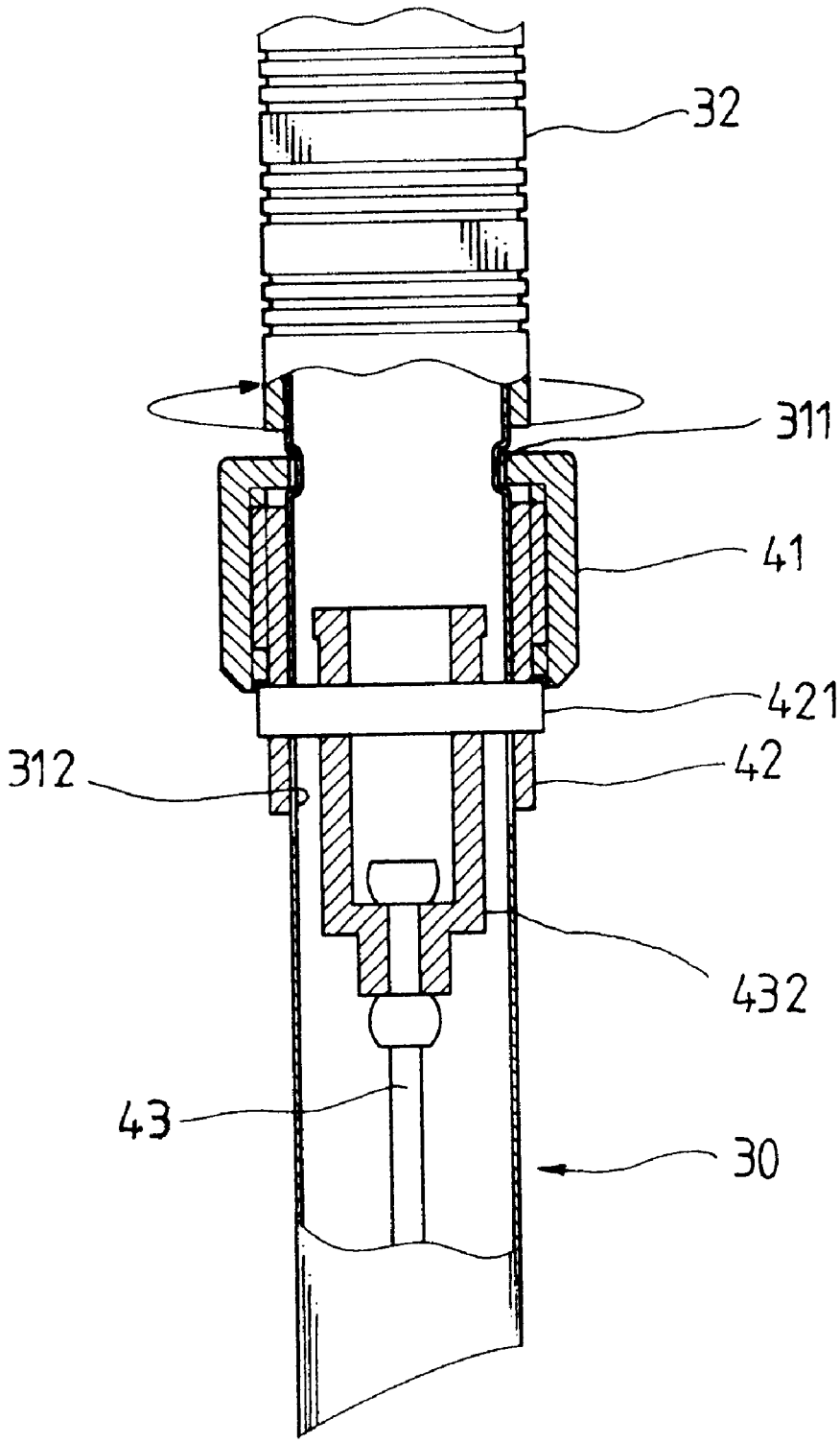
FIG. 7A is a cross sectional view to show the connection of the head, the movable member and the collar on the rod.

Further referring to FIG. 7A, a guide member 43 composed of several sections is received in the rod 30 and has a head 432 which is fixed to the movable member 42 by the pin 421. A valve body 44 is secured in the rod 30 by pins 441 (FIG. 8A) with seals 442 mounted thereto so as to be snugly received in the rod 30. The guide member 43 movably extends through the valve body 44. A chamber 444 is defined in the valve body 44 and an end member 46 on the guide member 43 is movably received in the chamber 444. A side hole 443 is defined through a wall of the valve body 44 and communicates with the chamber 444 of the valve body 44 and the aperture 315 in the rod 36. A distal end of the end member 46 is connected to the guide member 43 by a knob member 431 on a distal end of the guide member 43 and the distal end of the end member 46 is tapered in shape so as to disengageably seal a lower open end of the valve body 44.

Figure 7B:
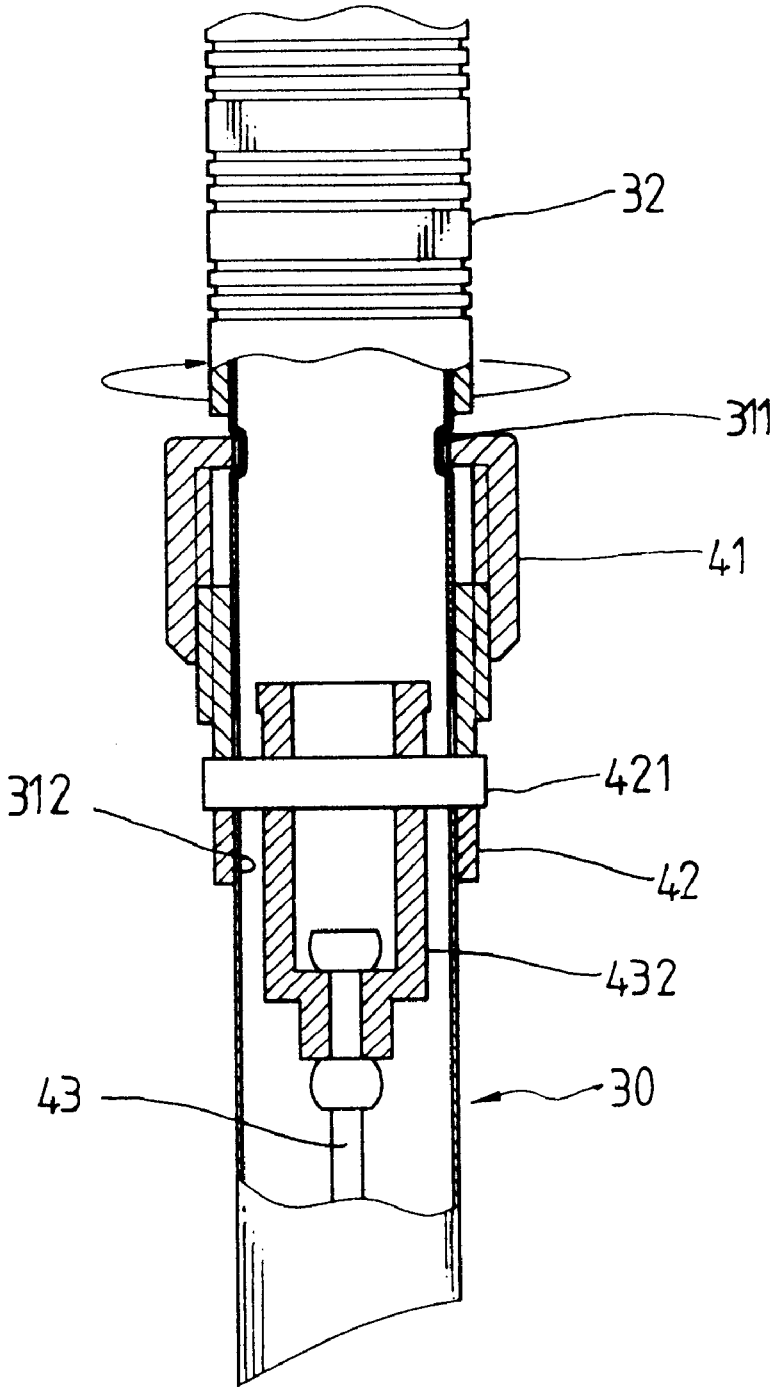
FIG. 7B shows the movable member is lowered by rotating the collar.
Figure 8B:
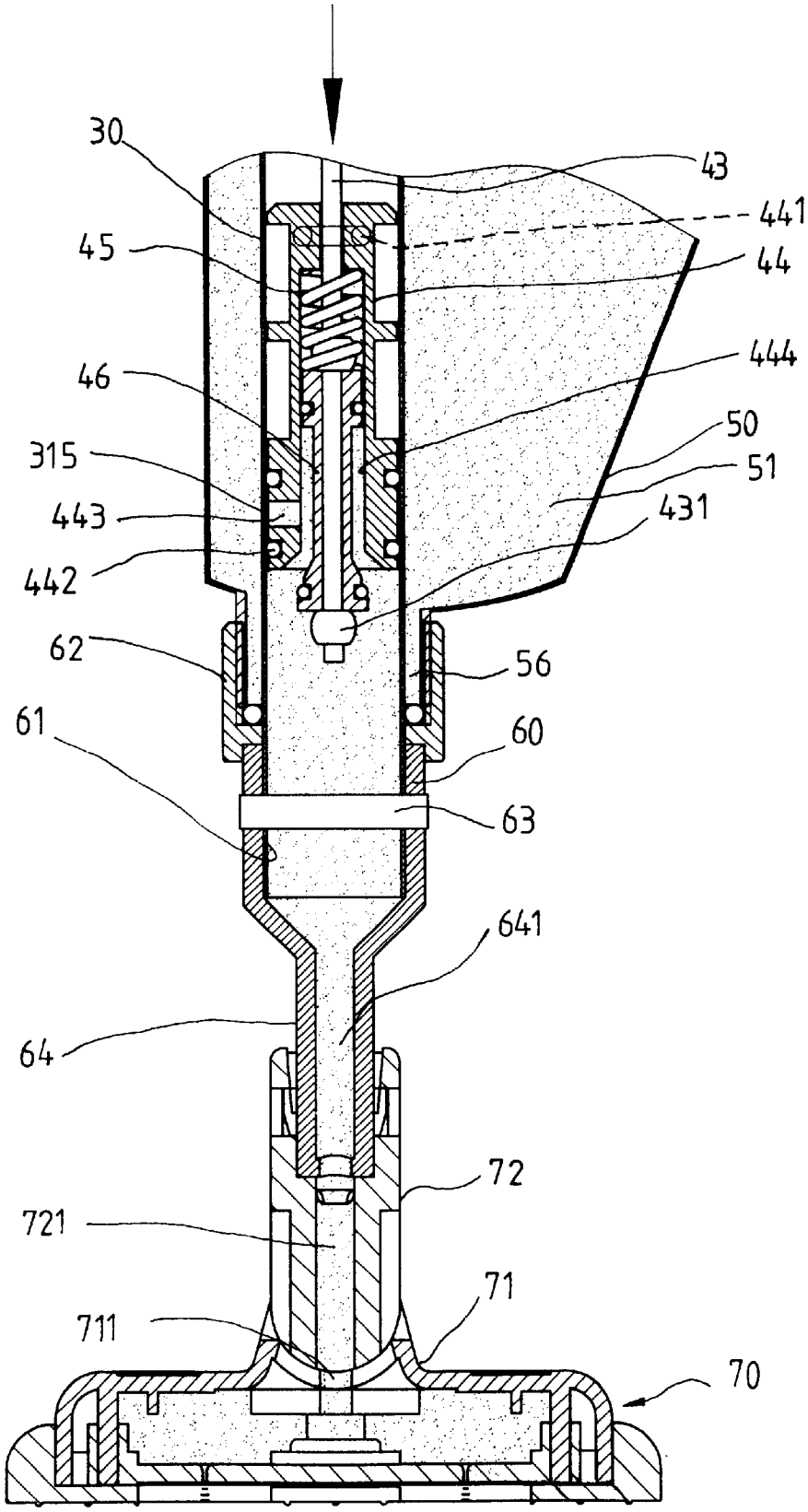
FIG. 8B shows when the guide member is lowered, detergent enters into the cleaning member.

When the collar 41 is not rotated, as shown in FIGS. 7A and 8A, the detergent is received in the chamber 444 and cannot enter the passage 641 in the connection piece 60. Referring to FIGS. 7B and 8B, when rotating the collar 41, the movable member 42 together with the head 432 are lowered, and the guide member 43 is pushed downward, a spring 45 received in the chamber 444 pushes the end member 46 to remove the distal end of the end member 46 from the lower open end of the valve body 44 so that the detergent flows through the lower open end of the valve body 44 and enters the cleaning member 70 via the passages 641, 721 and the hole 711. The lower open end of the valve body 44 is sealed again by rotating the collar 41 in opposite direction.

Figure 9:
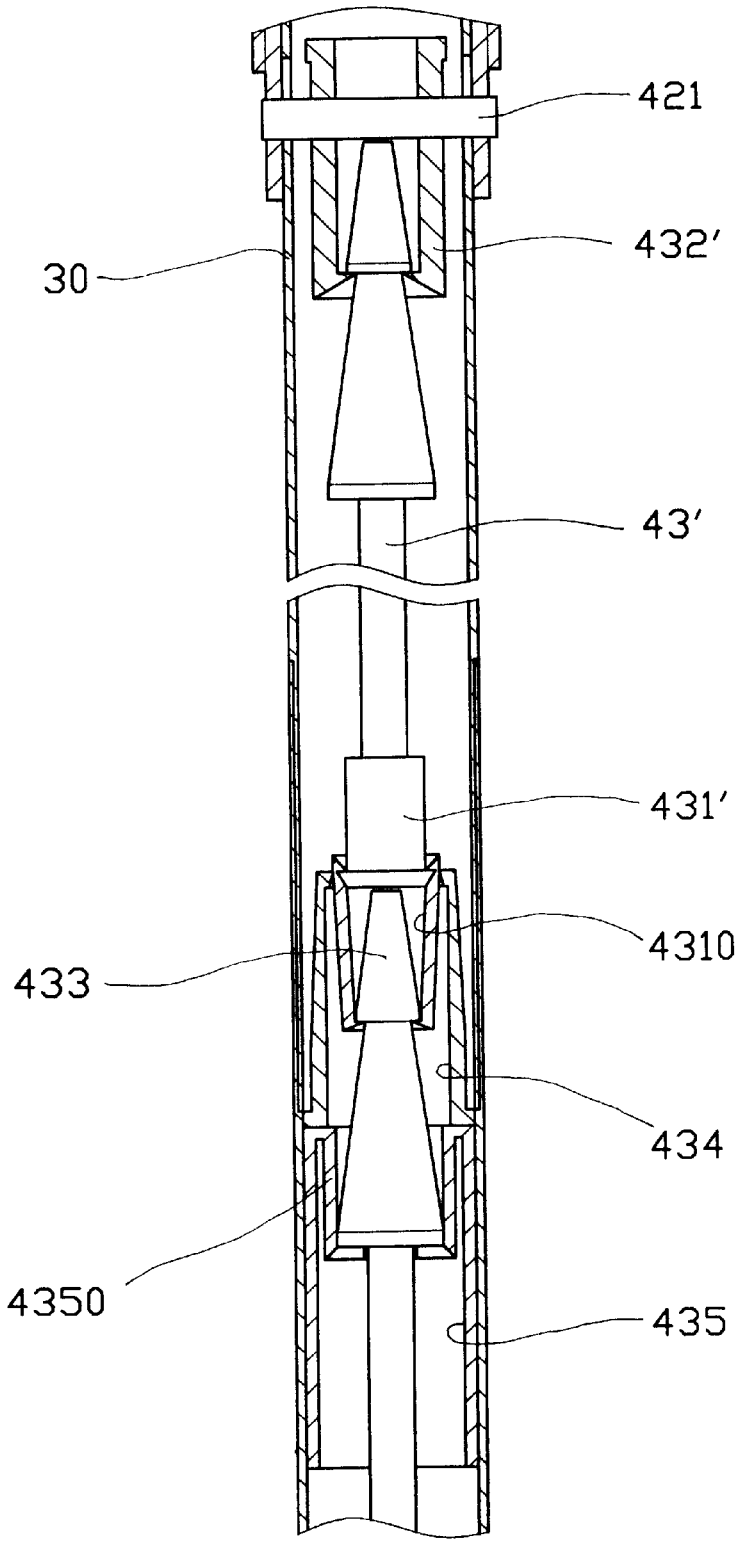
FIG. 9 is a cross sectional view to show another embodiment of the detergent feeding mechanism.

FIG. 9 shows another embodiment of the detergent feeding mechanism 40 which is composed of a head 432' connected to the rod 30 by the pin 421 and the guide member 43' is composed of two sections, a first section and a second section. The first section has a connection part 431' which is engaged with a connector 4310 which is made of flexible material. The connector 4310 has a hole defined through a bottom thereof and an arrow-shaped head 433 of the second section is engaged with the connector 4310 via the hole of the connector 4310. The connector 4310 is movable in a first sleeve 434 fixed to the inside of the rod 30. A second sleeve 435 is fixed to the inside of the rod 30 and located below the first sleeve 434. The second sleeve 435 includes a recessed portion 4350 and a hole is defined through the recessed portion 4350 so that a lower section of the arrow-shaped head 433 of the second section is engaged with the recessed portion 4350 via the hole in the recessed portion 4350. As shown in FIG. 9, the guide member 43' is lowered, so that when rotating the collar 41, the guide member 43', the connector 4310 and the second section of the guide member 43' are lifted to seal the lower open end of the valve body 44.

Figure 10:
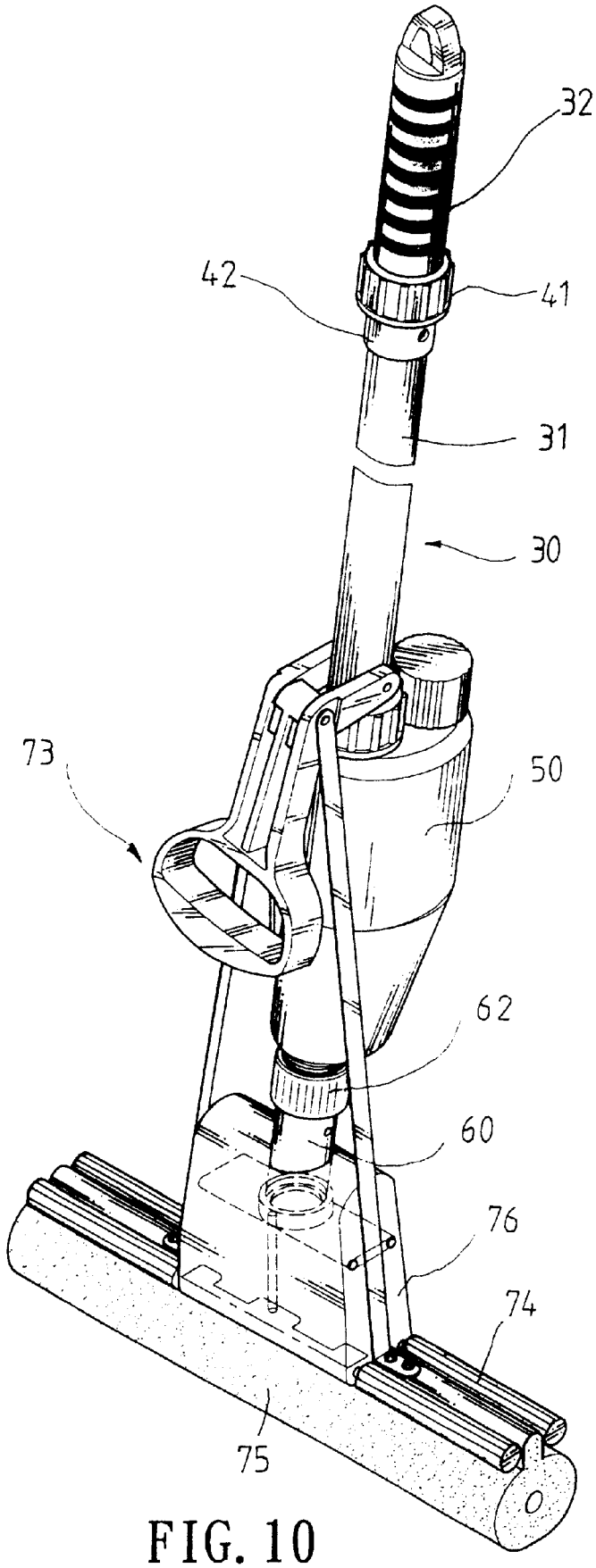
FIG. 10 shows the cleaning member is connected with a pull handle and squeeze device.

FIG. 10 shows that the present invention can be connected to a sponge 75 with a conventional squeeze device 73 and squeeze rollers 74. The sponge 75 is fixed to a frame 76 and the connection piece 60 is engaged with a hole in the frame 76 so that the detergent can be supplied to the sponge 75 via the hole.

While we have shown and described the embodiment in accordance with the present invention, it should be clear to those skilled in the art that further embodiments may be made without departing from the scope of the present invention.

What is claimed is:

1. A cleaning tool comprising:

a hollow rod having an aperture defined through the wall of the rod and located close to a lower open end of the rod;

a cleaning member connected to the lower open end of the rod;

a tank having a first fitting on a top of the tank and a second fitting on a bottom of the tank, the lower open end of the rod extending through the tank via the first fitting and the second fitting, the aperture in the rod located in the tank, and a detergent feeding mechanism including a collar which is rotatably mounted to the rod and located close to a handle portion of the rod, a movable member engaged with the collar and movable along the rod by rotating the collar, a guide member received in the rod and having a head which is fixed to the movable member, a valve body secured in the rod and the guide member movably extending through the valve body, a chamber defined in the valve body and an end member on the guide member movably received in the chamber, a side hole defined through a wall of the valve body and communicating with the chamber of the valve body and the aperture in the rod, a distal end of the end member disengageably sealing a lower open end of the valve body.

2. The cleaning tool as claimed in claim 1, wherein a first fixing collar and a second fixing collar are respectively threadedly mounted to the first fitting and the second fitting to fix the tank to the rod.

3. The cleaning tool as claimed in claim 1, wherein the collar is rotatably engaged with a groove defined in an outer periphery of the rod.

4. The device as claimed in claim 1, wherein a connection piece is securely mounted to the lower open end of the rod and includes a passage which communicates with the lower open end of the rod, a universal member connected to a lower end of the connection piece and pivotally connected to the cleaning member, a passage defined through the universal member and communicating with the passage in the connection piece.

5. The cleaning tool as claimed in claim 4, wherein the cleaning member includes two lugs between which the universal member is engaged, a hole defined through a top of the cleaning member and communicating with the passage in the universal member.

6. The device as claimed in claim 1, wherein a slot is defined through a wall of the rod and located close to the handle portion of the rod, a pin extending through the movable member and the slot so that the movable member is movable in a range of the slot by rotating the collar.

* * * * *